US005997327A

United States Patent [19]

Vergne et al.

[11] Patent Number: 5,997,327

[45] Date of Patent: Dec. 7, 1999

[54] POWER CONNECTION DEVICE

[75] Inventors: Jean-Claude Vergne, Bouchemaine; Gilles Soulard, Angers, both of France

[73] Assignee: Bull S.A., Louveciennes, France

[21] Appl. No.: 08/637,628

[22] PCT Filed: Oct. 20, 1995

[86] PCT No.: PCT/FR95/01390

§ 371 Date: Sep. 16, 1996

§ 102(e) Date: Sep. 16, 1996

[87] PCT Pub. No.: WO96/13078

PCT Pub. Date: May 2, 1996

[30] Foreign Application Priority Data

Oct. 24, 1994 [FR] France ..... 9412656

[51] Int. Cl.[6] ..... H01R 13/53

[52] U.S. Cl. ..... 439/181; 439/924.1

[58] Field of Search ..... 439/181, 924.1, 439/886, 887, 857; 361/622

[56] References Cited

U.S. PATENT DOCUMENTS

| | | | |
|---|---|---|---|
| 4,079,440 | 3/1978 | Ohnuma et al. . | |
| 4,331,375 | 5/1982 | Takamatsu . | |
| 4,845,589 | 7/1989 | Weidler et al. | 439/247 |
| 4,862,326 | 8/1989 | Blomstedt et al. | 361/622 |
| 4,867,713 | 9/1989 | Ozu et al. | 439/833 |
| 5,030,108 | 7/1991 | Babow et al. | 439/64 |
| 5,139,426 | 8/1992 | Barkus et al. | 439/65 |
| 5,413,510 | 5/1995 | Taylor | 439/886 |

FOREIGN PATENT DOCUMENTS

| | | |
|---|---|---|
| 0373675 | 6/1990 | European Pat. Off. . |
| 0386938 | 9/1990 | European Pat. Off. . |

*Primary Examiner*—Gary F. Paumen

*Attorney, Agent, or Firm*—Kerkam, Stowell, Kondracki & Clarke, P.C.; Edward J. Kondracki; John C. Kerins

[57] ABSTRACT

The present invention relates to a power connection device (1) which includes, on the one hand, a female part (2) with a lyre-shaped profile contained within and secured by an insulating support (3), which assembly is fixed inside a panel and is only accessible from one side, and on the other hand, a male part (6) to be plugged into said female part through said accessible side. This device is remarkable in that, in order to transfer high-intensity currents, the female part is composed of a thick, rigid multiclip (2) into which the male part, composed of a single thick plate (6), is inserted during the connection, which female part has a clamping zone (P) and which male part has a thickness (W) such that the insertion force is between 1.5 and 5 daN and that the resultant of the contact resistances is less than 60 NΩ.

16 Claims, 3 Drawing Sheets

POWER CONNECTION DEVICE

BACKGROUND OF THE INVENTION

1. Field of the Invention

The present invention relates to a power connection device which includes, on the one hand, a female part formed around a multiclip with a lyre-shaped profile contained within and secured by an insulating support, which assembly is fixed inside a panel and is accessible from only one side, and on the other hand, a male part to be plugged into this female part through the accessible side, which male part is composed of a single thick plate.

2. Description of Related Art

Generally, when it is desirable to achieve a power connection, a certain number of precautions must be taken. Thus, it is essential to reduce any contact resistance as much as possible. For this reason, the contact pieces are usually bolted to one another. This technique is reliable but not very practical, especially when the available space and/or volume remaining in an electronic panel makes access difficult, and particularly when the connection is accessible from only one side, which necessitates a long and difficult disassembly in the event of a failure. This drawback is further accentuated when, as is more and more often the case, redundant systems are used, in which case the power supply to the panel must generally be cut off so that the faulty module may be removed and replaced by a working module, thus eliminating the advantage of full utilization of the redundancy in a system.

One solution for avoiding this drawback consists of using, in place of bolted connections traditional elastic-type female connections, for example those with lyre-shaped profiles, into which male connectors are plugged. In order to allow the power transfer, particularly with high-intensity currents, given the thinness of these connectors, it is provided for a plurality of female connections of this type to be connected in parallel for the proper distribution of these currents, and it is not surprising in this case to find as many as fifty of these parallel connections. However, this solution has real drawbacks because it is almost impossible to obtain a very low contact resistance in each elementary female connection, given the disparities due to manufacturing tolerances as well as to the differences in their elasticity, a fact which implies a non-negligible resultant of the different elementary contact resistances.

Another solution consists of using a connection strip which is wide enough to support a high intensity and rigid enough to reduce the contact resistance. However, experience has shown that the contact cannot be made in such a way as to be distributed across the entire width of this strip, so this has the drawback of significantly increasing the contact resistance, which is contrary to the desired objective. Moreover, because of the width and the rigidity of the strip, if it is desirable to further reduce the contact resistance by increasing the clamping action, the insertion force necessary for plugging in the male piece becomes truly excessive.

SUMMARY OF THE INVENTION

The object of the present invention is to eliminate the various drawbacks of the different known solutions of the prior art, and to offer a power connection device which is simple, practical to install and to use, even when access is only possible from one side, and which, once the connection is achieved, has a considerably reduced contact resistance.

For this purpose, the power connection device mentioned in the preamble is remarkable in that, in order to transfer high-intensity currents, the female part is composed of a thick, rigid multiclip into which the male part is inserted during the connection, which female part has a clamping zone and which male part has a thickness such that the insertion force is between 1.5 and 5 daN and that the resultant of the contact resistances is less than 60 $\mu\Omega$.

Thus, according to the idea of the invention, the female part is composed of a thick, rigid multiclip which makes it possible to ensure that each of the pincers of the multiclip is applied with a pressure which is constant and sufficiently intense on the single thick plate composing the male part to obtain a uniform distribution of currents and to impose a minimal contact resistance while retaining a moderate insertion force during the connection. Furthermore, the thickness and the rigidity of the multiclip imply an elastic limit which is high enough not to cause any deformation of the clips and therefore high enough to maintain good reproducibility of the pressure exerted on the male part, even after a large number of insertions. Once the problem of the prior art has been solved thanks to the idea of the invention, by taking into account the example of application offered in the following description, one skilled in the art can determine the size of the connection and consequently of the multiclip and the thick plate for a given application.

BRIEF DESCRIPTION OF THE DRAWINGS

The following description in reference to the appended drawings, which is given as a non-limiting example, will make it clearly understood how the invention may be embodied.

FIG. 1 gives an example of embodiment of the power connection device, the support, the female part and the male part, which are shown in cross-section before insertion in FIG. 1*a*, while

DESCRIPTION OF THE PREFERRED EMBODIMENTS

Figure 1A:
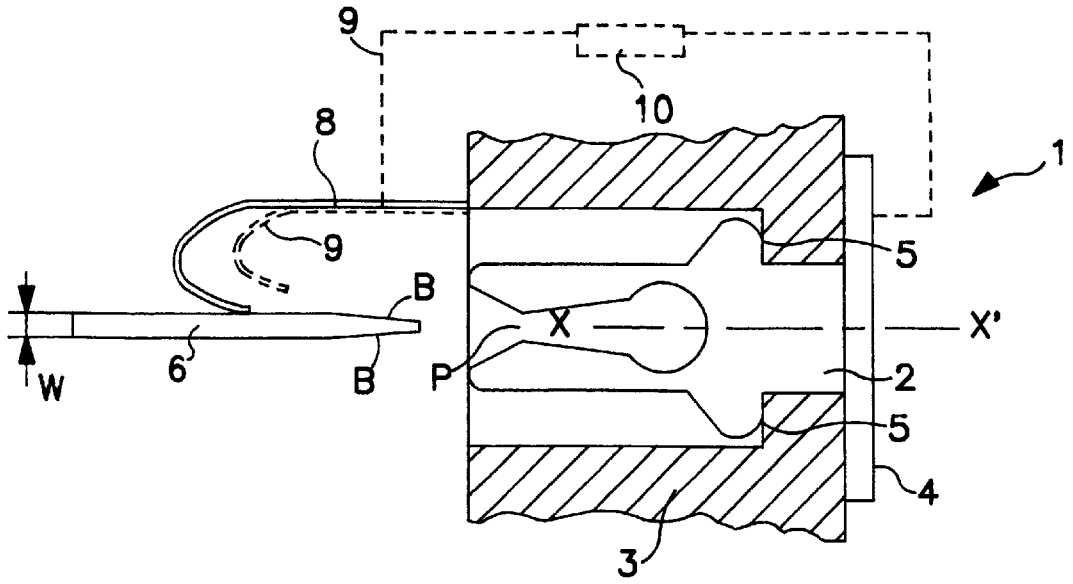
Figure 1B:
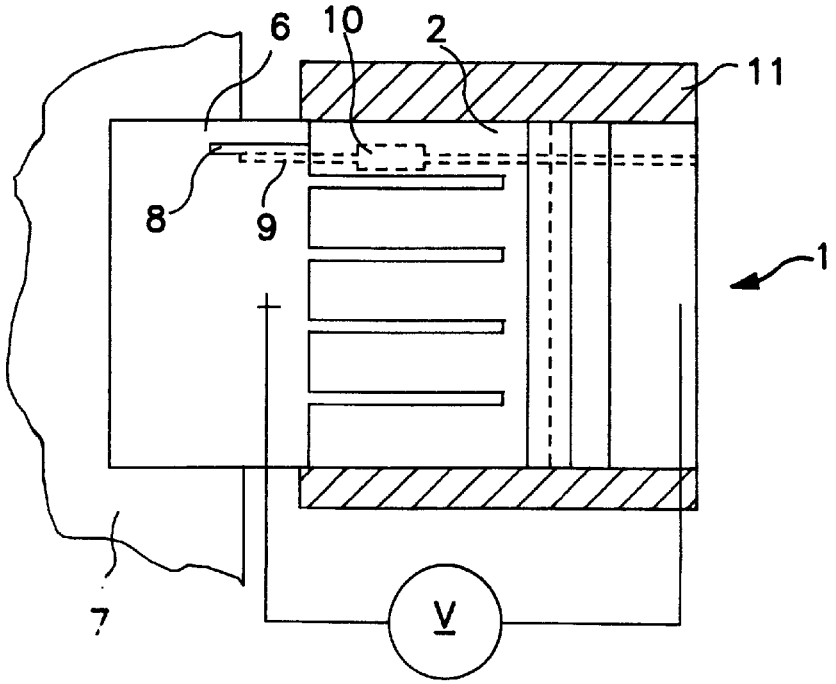
FIG. 1*b* shows the female part and the male part from FIG. 1*a* in a front view after insertion.

FIGS. 1*a* and 1*b* show the power connection device 1 in conformity with the invention. The power connection device 1 includes a female part 2 with a lyre-shaped profile contained within and secured by an insulating support 3, for example by means of a metal plate 4 which rests against the support 3 and is fixed, along the axis XX', by means of screws to the part 2, which assembly is fixed to the inside of a panel 11 and which is only accessible from one side, from the front of the panel. In this example, the female part 2, thanks to two collars 5, sits in a recess formed in the support 3. The metal plate 4 is itself connected to the cards or card slot to be supplied with power. The power connection device 1 also includes a male part 6 to be plugged into the female part through the accessible side, which part 6 of the device 1 is rendered integral with the card or the power supply module 7 to be connected. According to the idea of the invention, in order to transfer high-intensity currents, the female part is composed of a thick, rigid multiclip 2 (see FIG. 1*b*) into which the male part, composed of a single thick plate 6 (see FIG. 1*b*), is inserted during the connection, which female part has a clamping zone P and which male part has a thickness W such that the insertion force necessary to plug the plate 6 into the multiclip 2 is between 1.5 and 5 daN and that the resultant of the contact resistances is less than 60 $\mu\Omega$.

Preferably, the multiclip 2 is made of a cupreous material such as beryllium bronze, then heat treated and coated with silver. The heat treatment can consist of a natural aging for one hour at a temperature on the order of 760° C., followed by a tempering for three hours at a temperature on the order of 320° C., which makes it possible to obtain a Rockwell hardness 35–40 (320 HB±10%). The deposited silver coating has a thickness on the order of 10 microns.

Also preferably, the thick plate 6 composing the male part is made of copper, then coated with silver. The thickness of the silver coating is equivalent to that of the multiclip.

Specifically, the thick plate 6 includes a double bezel B at its insertion end. In effect, the plugging of the thick plate into the multiclip is done blindly inside the panel, and this characteristic of the plate thus makes it possible to advantageously facilitate a flexible insertion without using a hard point.

Two power connection devices 1 according to the invention are used to constitute a power supply connector, and in a remarkable way each power connection device also includes, fixed to the insulating support 3, an elastic metal contact called a preload contact, which preload contact corresponding to the ground potential 8 is directly connected to the corresponding connection device by means of an electric wire, while the preload contact corresponding to the non-null potential 9 is given a length (dotted line in FIG. 1*a*) which is shorter than that of the preload contact corresponding to the ground potential and is connected to the corresponding connection device through a low ohmic resistance 10 dotted line in FIG. 1*a*), for example on the order of two ohms. In this way, any abrupt voltage drop in the power supply due to the natural phenomenon of the load of the capacitors of the modules to be supplied, is avoided during the plugging. Instead of this, during the plugging, the longer preload contact which is connected to the ground is the first applied to the plate, which makes it possible to discharge any residual or parasitic voltage present in the terminals of the capacitors of the modules to be supplied, then the second, shorter contact connected to the non-null potential is in turn applied to the plate, which makes it possible, thanks to the low ohmic resistance, to preload the capacitors of the modules to be supplied, while limiting the current, at the moment of insertion, before the plates penetrate the multiclips. Thus, when the plates actually come into contact with the multiclips, these capacitors are already preloaded and an abrupt voltage drop is therefore avoided. The preload contacts must be given sufficient length to allow this preloading, for a given nominal plugging speed. This characteristic is also quite advantageous when applied to redundant systems, since it allows the plugging of a system for replacing a failed system without disturbing or requiring a cutoff of the power supply to the latter, which is in the process of operating.

Preferably, the contacts known as preload contacts are made of a cupreous material, then coated with silver.

Figure 2:
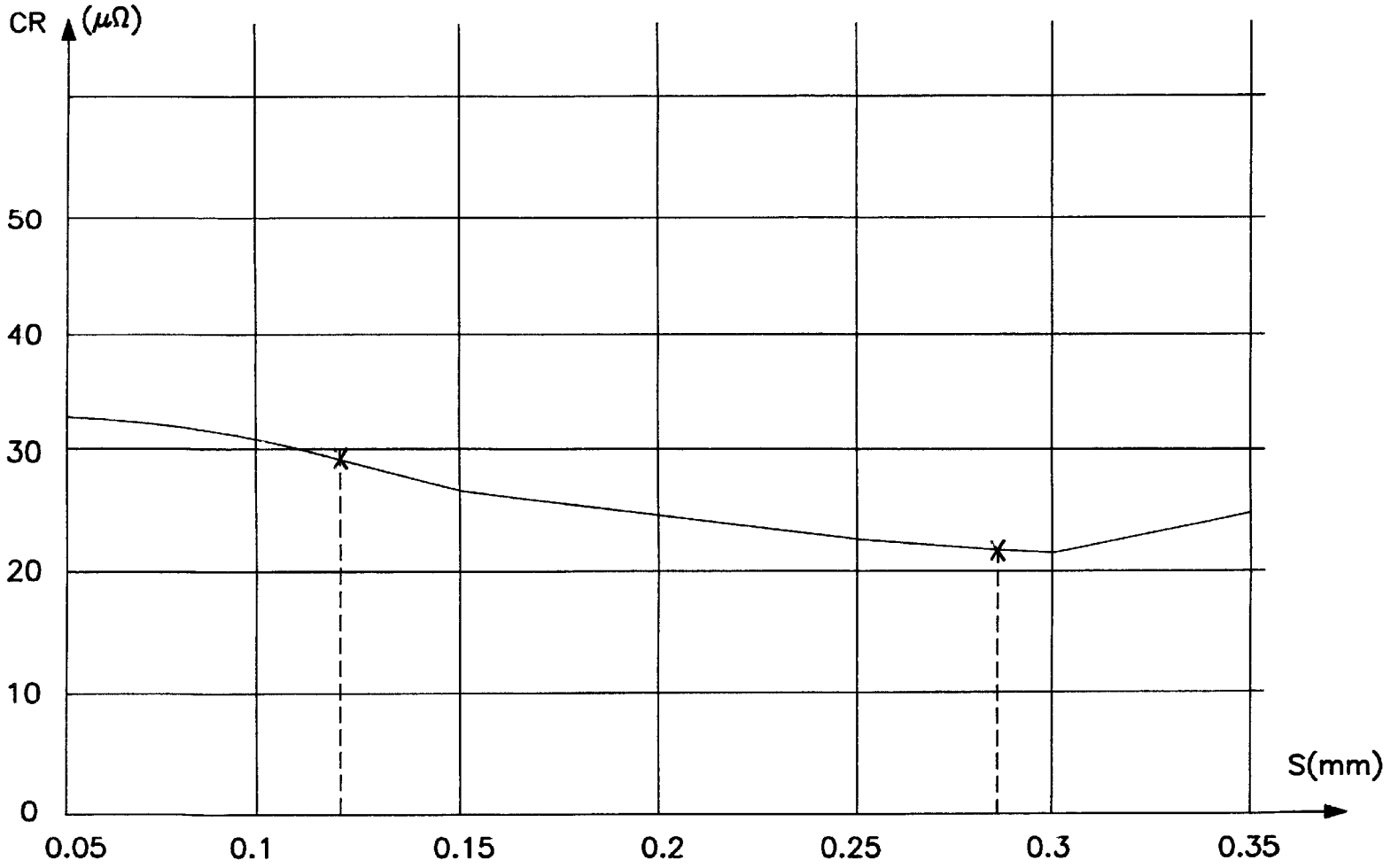
FIG. 2 suggests a curve of the variation of the contact resistance as a function of the squeezing.
Figure 3:
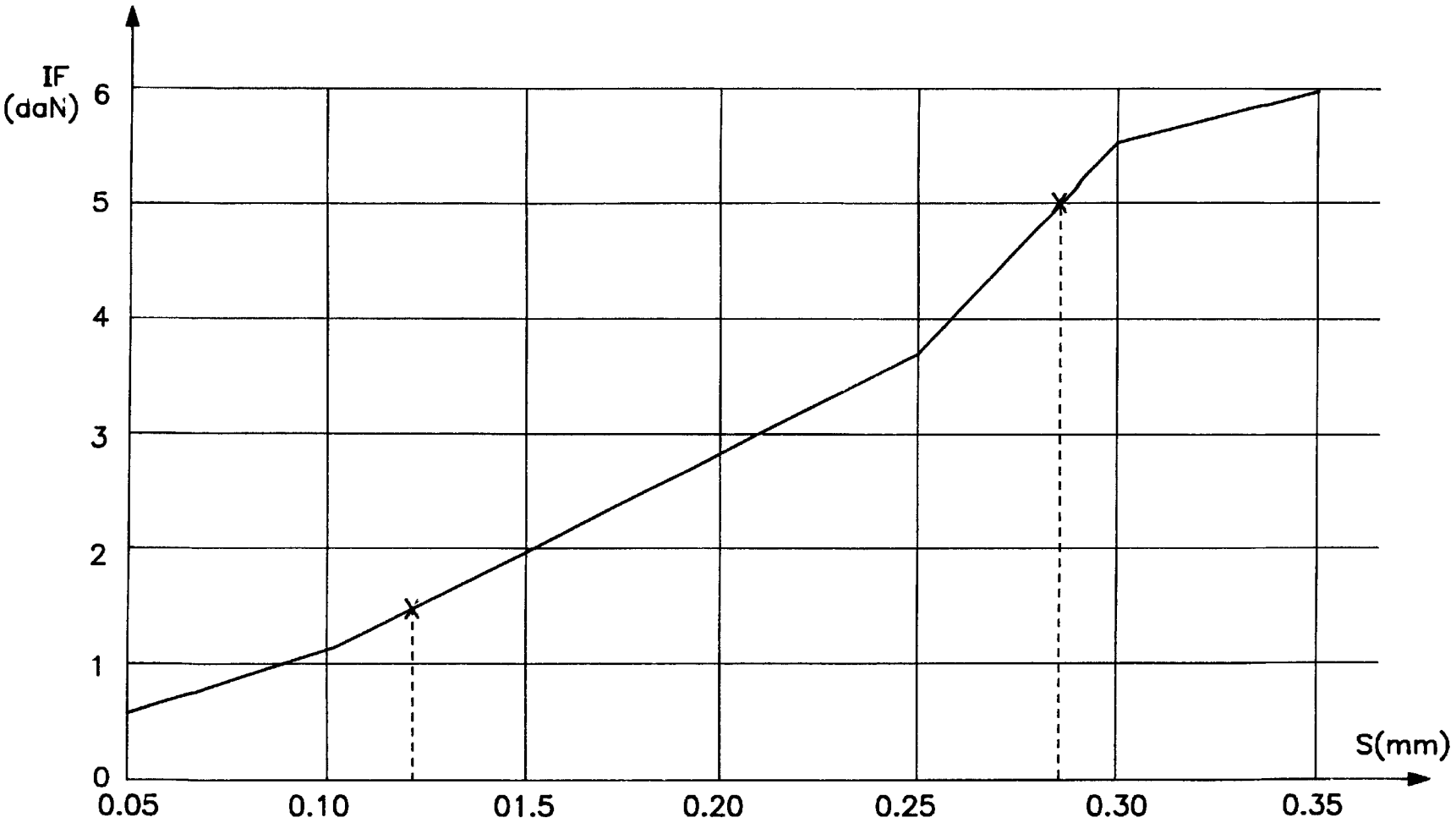
FIG. 3 suggests a curve of the variation of the insertion force as a function of the squeezing.

FIG. 2 suggests the plotting of a curve of the variation of the contact resistance CR as a function of the squeezing S, while FIG. 3 suggests a curve of the variation of the insertion force IF as a function of the squeezing S. These curves are representative of the average value of the results obtained in a set of samples in which the variable is the squeezing, which squeezing corresponds to the size difference between the thickness W of the plate 6 and the clamping zone P produced by the multiclip 2. Plates of different thicknesses, increasing from 0.05 mm by steps of 0.05 mm were used to produce these measurements. It was determined that the limit of elasticity of the multiclip was reached with a squeezing on the order of 0.35 mm.

The plotting of the curve of the variation of the contact resistance CR as a function of the squeezing S was done for a current intensity of 100 A, with the voltage being measured by means of a voltmeter V (FIG. 1*b*) connected between the plate and the multiclip in the median position for calculating the contact resistance. The device according to the invention, which was designed to operate at current intensities on the order of 150 to 200 A, was also tested under these conditions and performed satisfactorily. It must be noted that with a squeezing less than or equal to 0.1 mm, the measurement of the contact resistance is very delicate and difficult to reproduce, whereas on the contrary, this measurement becomes very easy at 0.15 mm and up. In FIG. 2, it appears that the minimal contact resistance, which is slightly greater than 20 $\mu\Omega$, is obtained with a squeezing on the order of 0.35 mm.

The plotting of the curve of the variation of the insertion force IF as a function of the squeezing S shows that a squeezing on the order of 0.27 mm, which corresponds to a value equal to 80% of the value considered to be the limit of elasticity, must be regarded as a maximum. In effect, the insertion force then reaches an intensity of 5 daN on average, which constitutes the maximum desired and acceptable value. The squeezing will therefore preferably be limited to the range from 0.13 to 0.27 mm so as to correspond to an insertion force between 1.5 and 5 daN, as desired. One skilled in the art will know how to deduce, from these results and these curves, the dimensions and tolerances relative to the thickness W of the plate and to the clamping zone P for a given application.

In conclusion, the power connection device in conformity with the present invention is simple, practical to install and to use even when access is only possible from one side, and once the connection is made, it has a significantly reduced contact resistance and therefore an efficient transfer of high-intensity currents, while allowing easy insertion. It allows, on the one hand, the connection of the output voltages from the power supplies by plugging, that is, from the modules to be connected from the freely accessible side and, on the other hand, the connection for supplying the logical power voltages of the cards or the card trays to a fixed structure in a panel, from the non-accessible side. Moreover, thanks to the utilization of preload contacts, it makes it possible to avoid any abrupt voltage drop in the power supply, a characteristic which is also very advantageous when applied to redundant systems, since it allows the plugging of a system for replacing a failed system without disturbing or requiring a cut-off of the power supply to the latter in the course of operation. This device has given excellent results during testing, even after a large number of insertions. While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the spirit and scope of the invention as set forth herein and defined in the claims.

We claim:

1. A power connection comprising a female part and a male part, said female part being fixed inside a panel and accessible only from one side and including a multiclip contained within an insulating support and having a lyre-shaped profile forming a clasping zone, said male part having an insertion end adapted to be inserted into said female part to enable transfer of currents and having a thickness relative to said clamping zone such that the force necessary to insert the male part into the female part is between 1.5 and 5 daN and the resultant of the contact resistances between the male part and the female part is less than 60 $\mu\Omega$, said power connection further including a preload contact assembly comprising a first elastic metal contact corresponding to ground potential and being directly connected to said female part and a second elastic metal contact corresponding to a non-null potential connected to said female part through a low ohmic resistance, said second contact having a length shorter than said first contact such that upon insertion of said male part into said female part, said male part first engages said first contact.

2. The power connection device according to claim 1, characterized in that the multiclip is a heat treated material coated with silver.

3. The power connection device according to claim 1, characterized in that the male part is a plate made of copper, coated with silver.

4. The power connection device according to claim 2, characterized in that the male part is a plate made of copper, coated with silver.

5. The power connection device according to claim 3, wherein the male part is a plate including a double bezel at an insertion end thereof.

6. The power connection device according to a claim 4, wherein the male part is a plate including a double bezel at an insertion end thereof.

7. The power connection according to claim 1, characterized in that the first and second contacts are of a cupreous material coated with silver.

8. The power supply connection device of claim 2 wherein the heat treated material is beryllium bronze.

9. A power supply connector having a pair of power connections each comprising a female part and a male part, said female part being fixed inside a panel and accessible only from one side and including a multiclip contained within an insulating support and having a lyre-shaped profile forming a clasping zone, said male part having an insertion end adapted to be inserted into said female part to enable transfer of currents and having a thickness relative to said clamping zone such that the force necessary to insert the male part into the female part is between 1.5 and 5 daN and the resultant of the contact resistances between the male part and the female part is less than 60 $\mu\Omega$, wherein each power connection further includes a preload contact assembly comprising a first elastic metal contact corresponding to ground potential and being directly connected to said female part and a second elastic metal contact corresponding to a non-null potential connected to said female part through a low ohmic resistance, said second contact having a length shorter than said first contact such that upon insertion of said male part into said female part, said male part first engages said first contact.

10. The power supply connector according to claim 9, characterized in that the multiclip is a heat treated material coated with silver.

11. The power supply connector according to claim 9, characterized in that the male part is a plate made of copper, coated with silver.

12. The power supply connector according to claim 10, characterized in that the male part is a plate made of copper, coated with silver.

13. The power supply connector according to claim 10, wherein the male part is a plate including a double bezel at an insertion end thereof.

14. The power supply connector according to claim 12, wherein the male part is a plate including a double bezel at an insertion end thereof.

15. A power supply connector as set forth in claim 9 wherein said first and second contacts are of cupreous material coated with silver.

16. The power supply connector as set forth in claim 10 wherein the heat treated material is beryllium bronze.

* * * * *

UNITED STATES PATENT AND TRADEMARK OFFICE

CERTIFICATE OF CORRECTION

PATENT NO : 5,997,327

DATED : December 7, 1999

INVENTOR(S) : Jean-Claude Vergne et al.

It is certified that error appears in the above-identified patent and that said Letters Patent are hereby corrected as shown below:

Claim 13, line 1, "claim 10" should read -- claim 11--.

Signed and Sealed this

Third Day of April, 2001

*Attest:*

NICHOLAS P. GODICI

*Attesting Officer*

*Acting Director of the United States Patent and Trademark Office*